US005186090A

United States Patent [19]

Bunch, Jr.

[11] Patent Number: 5,186,090

[45] Date of Patent: Feb. 16, 1993

[54] SHEETING APPARATUS

[75] Inventor: Earnest B. Bunch, Jr., Phoenix, Ariz.

[73] Assignee: B. Bunch Company, Inc., Phoenix, Ariz.

[21] Appl. No.: 722,670

[22] Filed: Jun. 28, 1991

[51] Int. Cl.[5] ..... B26D 1/02; B26D 1/56

[52] U.S. Cl. ..... 83/341; 83/349; 83/412; 83/436; 83/508; 83/508.2; 83/673

[58] Field of Search ..... 83/306, 341, 349, 412, 83/414, 421, 436, 508, 508.2, 673, 674

[56] References Cited

U.S. PATENT DOCUMENTS 3,869,950 3/1975 Serra ..... 83/341

4,119,003 10/1978 Corse ..... 83/341

*Primary Examiner*—Douglas D. Watts
*Assistant Examiner*—Raymond D. Woods
*Attorney, Agent, or Firm*—Tod R. Nissle

[57] ABSTRACT

Apparatus for cutting a strip of paper along transverse cut lines spaced along the strip of paper. The apparatus permits ready access to adjustable paper cutting blades utilized in the apparatus and enables ready adjustment of the direction of travel of the strip of paper with respect to the cutting blades to compensate for skewing of the cut lines wiht respect to the longitudinal axis of the strip of paper.

3 Claims, 2 Drawing Sheets

SHEETING APPARATUS

This invention relates to apparatus for cutting a strip of paper along transverse cut lines spaced along the strip of paper.

More particularly, the invention relates to paper cutting apparatus which permits ready access to adjustable paper cutting blades utilized in the apparatus and which enables ready adjustment of the direction of travel of the strip of paper with respect to the cutting blades to compensate for skewing of the cut lines with respect to the longitudinal axis of the strip of paper.

Apparatus for cutting a strip of paper into series of equal sized sheets is well known in the art. Such apparatus includes a first elongate fixed blade and a second blade. The second blade is mounted on the surface of a rotating cylinder such that during each rotation of the cylinder the second blade contacts or passes immediately adjacent the first blade to cut transversely a piece of paper which is passing between the blades. The second blade is shaped or is positioned such that the first and second blades do not instantly and simultaneously cut the strip of paper at all points along the entire length of a cut line. Instead, the blades begin to cut the strip of paper at one edge and continue to cut the strip of paper along a line such that the cut portion of the paper grows progressively closer to, and finally reaches, the other edge of the strip of paper, much in the same fashion that a pair of scissors gradually and progressively cuts a piece of paper from one side to the other. In other words, the first and second blades cut some points along a cut line at different times than other points on the cut line.

One of the disadvantages of prior art paper cutting apparatus is that installing or adjusting the fixed cutting blade is awkward and time consuming because the fixed blade is positioned beneath the second blade. Another disadvantage of conventional apparatus for cutting a strip of paper is that as the distance between the cut lines varies, the cut lines begin to skew with respect to the longitudinal axis of the paper. When the cut lines begin to skew, they are no longer perpendicular to the longitudinal axis of the paper.

Accordingly, it would be highly desirable to provide an improved apparatus which would "sheet" or cut a strip of paper along cut lines at equally spaced intervals therealong and which would permit ready access to both cutting blades and wold permit ready adjustment of the apparatus to compensate for skewing of the cut lines which occurs when the distance between cut lines is altered.

Figure 1:
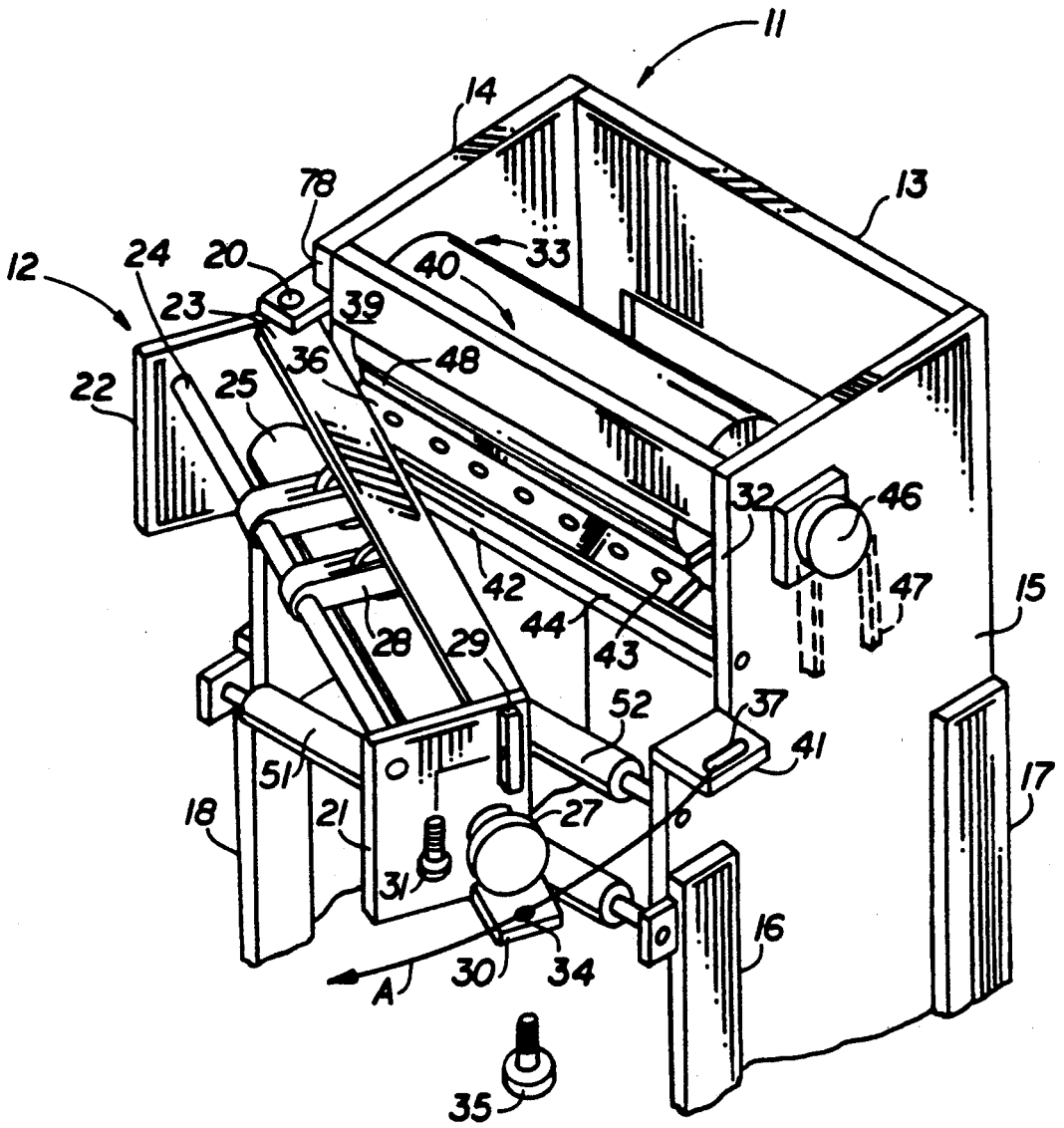
Figure 2:
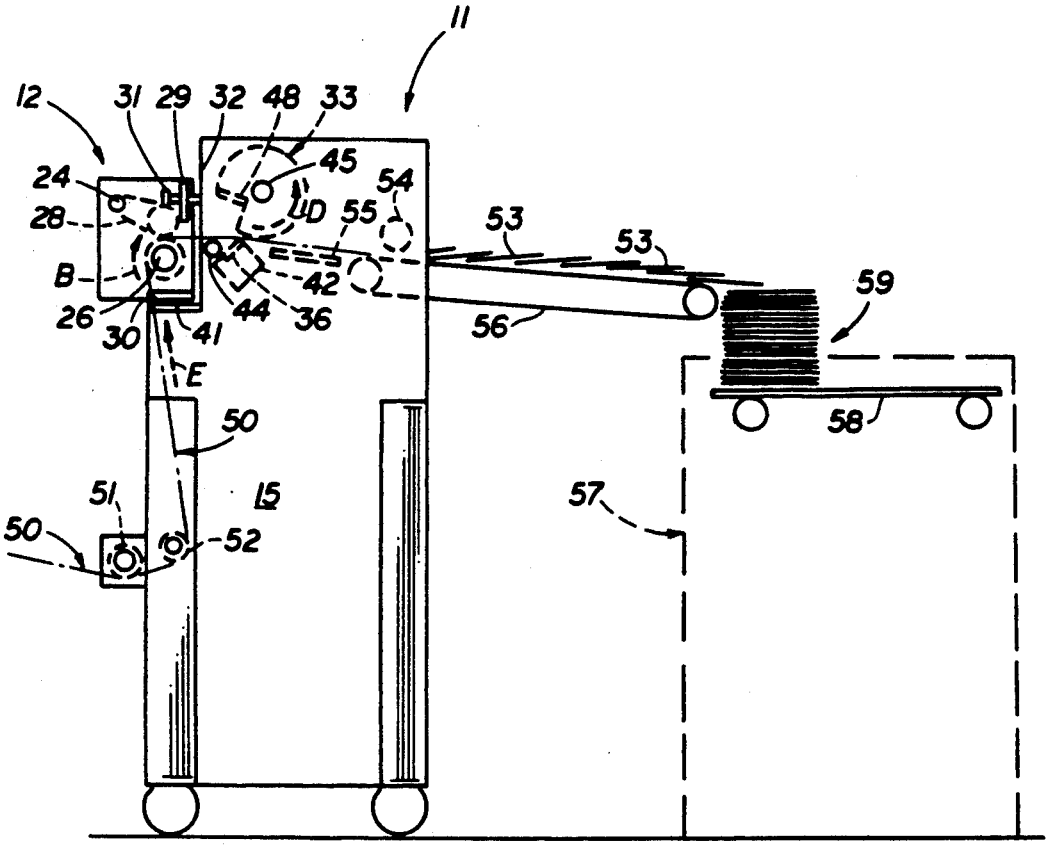
Figure 3:
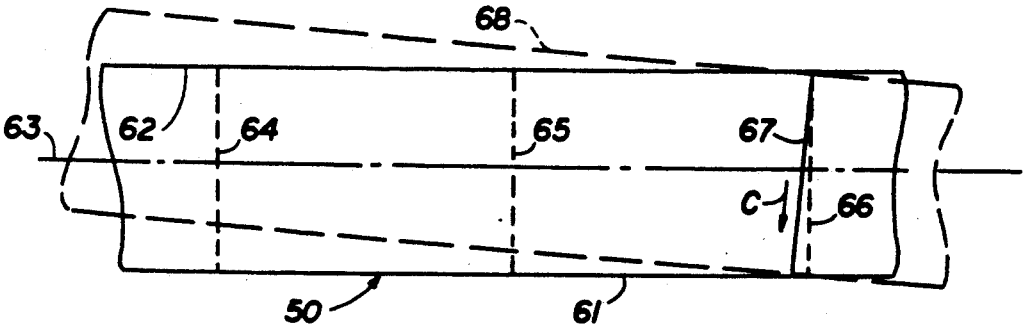

These and other, further and more specific objects and advantages of the invention will be apparent to those skilled in the art from the following detailed description thereof, taken in conjunction with the drawings, in which:

FIG. 1 is a perspective view illustrating paper cutting apparatus constructed in accordance with the principles of the invention;

FIG. 2 is a side elevation view of the apparatus of FIG. 1 further illustrating construction details thereof; and, FIG. 3 is a top view of a strip of paper illustrating the skewing of cut lines with respect to the longitudinal axis of the paper and illustrating how the apparatus of the invention compensates for such skewing to insure that cut lines are perpendicular to the longitudinal axis of the paper.

Briefly, in accordance with my invention, I provide apparatus for cutting a strip of paper at selected equal intervals therealong, the strip of paper including first and second spared apart edges and a longitudinal axis. The apparatus includes primary frame means having an exterior surface; a first fixed blade adjustably mounted in the primary frame means; a second blade mounted in the primary frame means on a support surface; means for rotating the support surface and the second blade about an axis such that the second blade contacts the first blade at selected intervals to cut a strip of paper passing between the first and second blades transversely from the first edge to the second edge of the strip of paper; and an opening formed in .he primary frame means and leading from the exterior surface of the primary frame means to the first blade; secondary frame means; and, a driven feed roller rotatably mounted on the second frame means for dispensing the strip of paper into the opening and between the support surface and the first blade. The secondary frame means is connected to the primary frame means for movement between at least two operative positions, a first operative position covering the opening with the feed roller in a primary operative position to dispense the strip of paper into the opening and between the support surface and the first blade, and a second operative position with the feed roller displaced away from the first operative position and from the opening to uncover the opening to access the first blade through the opening for adjustment of the position of the first blade on the primary frame means.

In another embodiment of the invention I provide apparatus for cutting a strip of paper at selected equal intervals therealong, the strip of paper including first and second spaced apart edges and a longitudinal axis. The apparatus includes primary frame means having an exterior surface; a first elongate blade adjustably mounted in the primary frame means and having a longitudinal axis; a second blade mounted on the primary frame means on a support surface; means for rotating the support surface and the second blade about an axis such that the second blade contacts the first blade at selected intervals to cut a strip of paper passing between the first and second blades transversely along a cut line extending from the first edge to the second edge of the strip of paper at a first selected angle; and an opening formed in the primary frame means and leading from the exterior surface of the primary frame means to the first blade; secondary frame means; a driven feed roller rotatably mounted on the second frame means for dispensing the strip of paper into the opening and between the support surface and the first blade such that the longitudinal axis of the strip of paper is at a second selected angle with respect to the longitudinal axis of the first blade; and, means for adjusting the second selected angle to alter said first selected angle to compensate for the skewing of said cut line with respect to the longitudinal axis of the strip of paper which occurs when the interval between cut lines is altered.

Turning now to the drawings, which depict the presently preferred eabodiments of the invention for the purpose of illustrating the practice thereof and not by way of limitation of the scope of the invention, and in which like reference characters refer to corresponding elements throughout the several views, FIGS. 1 and 2 illustrate a paper strip cutting machine constructed in accordance with the invention and including primary frame means 11 and secondary frame means 12. Frames means 11 includes front panel 13 connected to side panels 14 and 15. Reinforcing panels 16 and 17 are attached to panel 15. Reinforcing panels 19 (not visible) and 18 are connected to panel 14. One side of frame means 12 is pivotally connected to primary frame means 11 by hinge joint 20 such that the other side of frame means 12 can pivot outwardly in the direction of arrow A from the first operative position of means 12 shown in FIG. 2. Frames means 12 includes side panels 21, 22 interconnected by panel 23 and fixed shaft 24. Feed roller 25 is fixedly attached to shaft 26. The ends of shaft 26 are journalled for rotation in side panels 21, 22. Pulley 27 is fixedly attached to one end of shaft 26 and is turned by a belt (not shown). When pulley 27 is turned by a belt, pulley 27 rotates shaft 26 and feed roller 25. Roller 25 turns in the direction indicated by dashed arrow B in FIG. 2. A pair of guide roller units 28 ride on top of feed roller 25.

Flanges 29 and 30 are fixedly attached to side panel 21. An internally aperture formed through flange 29 receives externally threaded bolt 31. As shown in FIG. 2, when bolt 31 is threaded through the aperture in flange 29, the end of bolt 31 contacts vertical exterior edge surface 32 of panel 15. Accordingly, turning bolt 31 through the aperture in flange 29 controls the point of closest approach of side panel 21 to edge 32, controls the angle between the longitudinal axis of cylindrical roller 25 and the longitudinal axis of roller 33, and controls the angle between the longitudinal axis of the strip of paper 50 passing through the apparatus and the longitudinal axes of rollers 25, 33 and of blade 36.

When the secondary frame means 12 is in the closed first operative position illustrated in FIG. 2, frame means 12 is anchored in position by slidably inserting the externally threaded end of bolt 35 through slot 37 of flange 41 and into the internally threaded aperture 34 formed through flange 30. Bolt 35 is turned into aperture 34 until the head of the bolt 35 bears tightly against flange 36 and secures frame means 12 in the closed first operative position of FIG. 2. After bolt 35 is removed from aperture 34 and slot 37 in the manner shown in FIG. 1, then frame 12 means can be swung outwardly in the direction of arrow A to an open second operative position to allow access to the opening which is formed in frame means 11 and leads to blade 36. The opening leading to blade 36 passed through and is bounded by the exterior surface 39 of panel 40 and by exterior edge surfaces 32 and 78 of panels 15 and 14, respectively. When frame means 12 is in the closed first operative position of FIG. 2, frame means 12 covers the opening and prevents access to the blade 36.

Blade 36 is fixedly attached to elongate rectangular member 42 by a plurality of screws 43. Holes (not visible) are formed in blade 36 to receive screws 43. Each hole is larger than its screw 43 so that the position of blade 36 on member 42 can be adjusted before the screws 43 are fully tightened to fix the position of blade 36 on member 42.

The ends of shaft 44 are attached to panels 14 and 15. Cylindrical roller 33 is fixedly attached to shaft 45. The ends of shaft 45 are journalled for rotation in panels 14 and 15. Pulley 46 is connected to one end of shaft 45. An endless belt 47 is utilized to transmit motive power to pulley 46. When pulley 46 is turned by belt 47, shaft 45 and cylindrical roller 33 rotate in the direction indicated by arrow D in FIG. 2. Blade 48 is connected to the outer surface of roller 33. Blades 48 and 36 are shaped and dimensioned and/or are mounted with respect to one another such that when a strip of paper is moving between roller 33 and blade 36 and blades 36, 48 contact or pass immediately adjacent on another, the strip of paper is transversely cut from edge to edge in the same manner that a pair of scissors cuts a piece of paper. In other words, the blades 48, 36 do not instantly simultaneously cut a strip 50 of paper at all points along the entire length of a transverse cut line. Instead, blades 36, 48 begin cutting the strip of paper at an edge or some other point and continue sequentially cutting points along the cut line until the strip of paper 50 is completely or partially severed.

In use, secondary frame means 12 is opened in the direction of arrow A as indicated in FIG. 1. Blades 36, are installed or adjusted, as the case may be. Secondary frame means 12 is then closed to the position shown in FIG. 2 and bolt 35 is adjusted so that side panel 21 is a desired distance from exterior edge surface 32. The externally threaded end of bolt 35 is then slid through aperture 37 and threaded into aperture 34 to turn the head of bolt 35 against flange 41 and tighten frame means 12 in position. A motor or other source of motive power is used to move the belts which turn pulleys 27 and 46. A strip of paper 50 is, as indicated in FIG. 2 by arrow E, drawn over rollers 51, 52, and 25 and directed between roller 33 and blade 36. The speed of roller 33 with respect to the speed of movement of strip 50 is adjusted such that blades 36 and 48 cut paper strip 50 at selected equally spaced intervals to produce sheets 53 of generally equal size and dimension. Increasing the speed of roller 33 with respect to the speed of movement of strip 50 reduces the distance between successive cut lines on strip 50. Blade 36 normally is moving at a greater speed of travel or velocity in feet per minute than is strip 50. The speed of roller 33 with respect to the speed of strip 50 can also, of course, be altered by changing the speed of strip 50 while the speed of roller 33 remains constant or by altering the speed of both strip 50 and roller 33 each by a different amount. The sheets 53 pass over flat guide 55 and beneath rollers 54 onto conveyor belt 56. Belt 56 carries sheets 53 to a stacker assembly 57. A table 58 in the stacker assembly 57 gradually lowers as the height of the stack 59 of sheets 53 on the table 58 increases.

As shown in FIG. 3, the strip of paper 50 passing through the apparatus of FIGS. 1 and 2 typically includes parallel spaced apart edges 61, 62, and longitudinal axis 63. Axis 63 is equidistant from each edge 61, 62. In FIG. 3 dashed lines 64 to 66 each represent a cut line along which a strip 50 of paper or other material is to be cut. The distance between each successive pair 64—65, 65—66, etc. of cut lines is generally equal. As earlier noted, since blades 36, 48 do not instantly cut strip 50 along the entire length of a cut line 64, 65, 66, but instead cut from one side or part of strip 50 to another side or part of strip 50, the actual cut line, represented by reference character 67 in FIG. 3, can be skewed with respect to the longitudinal axis 63 (i.e., the actual cut line is skewed because it is not perpendicular to axis 63). When the velocity of strip 50 remains constant, when the angle between axis 63 and the longitudinal axis of roller 33 or blade 36 remains constant, and the speed of rotation of roller 33 is altered, then the angle of line 67 with respect to axis 63 and the desired cut line 66 is altered. As would be appreciated by those of skill in the art, the degree or amount of skewing of line 67 is exaggerated in FIG. 3. In FIG. 3, arrow C indicates the direction in which blades 36, 48 cut strip 50 from edge 62 to edge 61. The skewing of line 67 with respect to axis 63 of paper strip 50 can be compensated for by altering the angle of axis 63 with respect to the longitudinal axis of roller 33 and the longitudinal axis of rectangular elongate blade 36. The spacings between the axes of blades 36, 48 and rollers 33 25 are fixed during operation of the apparatus of FIGS. 1 and 2 and, in general, these axes are parallel. The angle of axis 63 with respect to the longitudinal axis of roller 33 or to any other fixed axis in the apparatus of FIGS. 1 and 2 can be altered by loosening bolt 35 and turning bolt 31 into and out of the aperture in flange 29 to alter the distance of panel 21 from exterior surface edge 32 and to alter the angle of the longitudinal axis of roller 25 with respect to the longitudinal axes of roller 33 and blades 36, 48. If, for example, FIG. 3 is a top view of strip 50 as it passes between blades 36, 48, then threading bolt 31 into the aperture in flange 29 forces panel 21 away from edge surface 32 and tends to move strip 50 to an orientation like that indicated by dashed lines 68. When strip 50 is moved to the position indicated by dashed lines 68, the longitudinal axis of the paper strip is, as it should be, perpendicular to the actual cut line 67. When bolt 31 is utilized to vary the distance between panel 21 and edge surface 32, frame means 12 and roller 25 pivot about hinge joint 20.

After bolt 35 is loosened and bolt 31 is used in the manner described above to alter the position of frame means 12, roller 25, and panel 21, then bolt 35 is again tightened to secure frame means 12 in the closed first operative position with respect to frame means 11.

When the apparatus of FIGS. 1 and 2 is utilized to cut a paper strip, the paper strip is moving through the apparatus. The strip of paper 50 is not stationary when it is cut. Movement of paper 50 is not halted in order to cut paper 50.

Having described my invention in such terms as to enable those skilled in the art to understand and practice it, and having identified the presently preferred embodiments thereof, I Claim:

1. Apparatus for cutting a trip of paper at selected equal intervals therealong, the strip of paper including first and second spaced apart edges and a longitudinal axis, said apparatus including (a) primary frame means having an exterior surface;

(b) a first blade adjustably mounted on said primary frame means such that the position of said first blade on said primary frame means can be adjusted;

(c) a second blade mounted in said primary frame means on a support surface;

(d) means for rotating said support surface and said second blade about an axis such that said second blade intermittently contacts said first blade at selected intervals to cut a strip of paper passing between said first and second blades transversely from the first edge toward the second edge of the strip of paper;

(e) an opening formed in said primary frame means and leading from said exterior surface of said primary frame means to said first blade, said opening permitting access to said first blade to allow adjustment of the position of said first blade on said primary frame means;

(f) secondary frame means;

(g) a driven feed roller rotatably mounted on said secondary frame means for dispensing the strip of paper into said opening and between said support surface and said first blade; said secondary frame means being connected to said primary frame means for movement between at least two operative positions, (h) a first operative position covering said opening with said feed roller in a primary operative position to dispense said strip of paper into said opening and between said support surface and said first blade; and, (i) a second operative position with said feed roller displaced away from said first operative position and from said opening to uncover said opening to allow access to said first blade through said opening for adjustment of the position of said first blade on said primary frame means.

2. Apparatus for cutting at strip of paper at selected equal intervals therealong, the strip of paper including first and second spaced apart edges and a longitudinal axis, said apparatus including (a) primary frame means having an exterior surface;

(b) a first elongate blade mounted in said primary frame means, and having a longitudinal axis;

(c) a second blade mounted in said primary frame means on a support surface;

(d) means for rotating at a selected speed said support surface and said second blade about an axis such that said second blade intermittently contacts said first blade at selected intervals to cut a strip of paper passing between said first and second blades transversely along spaced apart cut lines each comprised of a series of points and extending from the first edge toward the second edge of the strip of paper at a first selected angle with respect to the longitudinal axis of the strip of paper, said blades sequentially cutting said points comprising each of said cut lines;

(e) an opening formed in said primary frame means and leading from said exterior surface of said primary frame means to said first blade;

(f) secondary frame means;

(g) a driven feed roller rotatably mounted on said secondary frame means for dispensing at a selected speed the strip of paper into said opening and between said support surface and said first blade such that the longitudinal axis of the strip of paper is at a second selected angle with respect to said longitudinal axis of said first blade; and, (h) means for adjusting said secondary frame means to alter said second selected angle to compensate for skewing of said cut lines with respect to the longitudinal axis of the strip of paper when the interval between cut lines is altered by altering said selected speed of rotation of said support surface with respect to said selected speed of movement of the strip of paper.

3. The apparatus of claim 2 wherein (a) said first blade is adjustably mounted on said primary frame means such that the position of said first blade on said primary frame means can be adjusted;

(b) said opening permits access to said first blade to allow adjustment of the position of said first blade on said primary frame means; and (c) said secondary frame means is pivotally connected to said primary frame means for movement between at least two operative positions, (i) a first operative position covering said opening with said feed roller in a primary operative position to dispense said strip of paper into said opening and between said support surface and said first blade; and, (ii) a second operative position with said feed roller pivoted away from said first operative position and from said opening to uncover said opening to allow access to said first blade through said opening for adjustment of the position of said first blade on said primary frame means.

* * * * *